United States Patent [19]

Horie et al.

[11] Patent Number: 4,502,982

[45] Date of Patent: Mar. 5, 1985

[54] IRON CORE MATERIAL

[75] Inventors: Hiromichi Horie, Yokosuka; Kazumi Shimotori, Kawasaki; Hideki Murabayashi, Yokohama, all of Japan

[73] Assignee: Tokyo Shibaura Denki Kabushiki Kaisha, Kawasaki, Japan

[21] Appl. No.: 469,270

[22] Filed: Feb. 24, 1983

[30] Foreign Application Priority Data

Feb. 26, 1982 [JP] Japan ..... 57-28928

[51] Int. Cl.[3] ..... H01B 1/02

[52] U.S. Cl. ..... 252/513; 524/440

[58] Field of Search ..... 252/513; 524/440; 428/900, 458, 465

[56] References Cited

U.S. PATENT DOCUMENTS

| | | | |
|---|---|---|---|
| 3,923,946 | 12/1975 | Meyer | 264/111 |
| 4,004,997 | 1/1977 | Tsukamoto et al. | 252/513 |
| 4,268,430 | 5/1981 | Suzuki et al. | 252/513 |

FOREIGN PATENT DOCUMENTS

| | | |
|---|---|---|
| 112235 | 11/1934 | Japan . |
| 670520 | 6/1972 | Japan . |
| 858018 | 8/1973 | Japan . |
| 403368 | 12/1933 | United Kingdom . |

*Primary Examiner*—Josephine L. Barr

*Attorney, Agent, or Firm*—Schwartz, Jeffery, Schwaab, Mack, Blumenthal & Koch

[57] ABSTRACT

Disclosed is an iron core material, comprising a high density compression molded product of a mixture of magnetic powder of iron or iron alloy having a mean particle size of 100μ or less and an insulating caking material such as thermosetting resins. The magnetic powder, when its mean particle size is represented by Dμ and its resistivity by ρμΩ −cm, is preferred to have a value of the resistivity which may satisfy the following equation:

$$\frac{\rho}{D^2} \geqq 4 \times 10^{-3}.$$

6 Claims, 2 Drawing Figures

IRON CORE MATERIAL

BACKGROUND OF THE INVENTION

This invention relates to an iron core material, more particularly to an iron core material which is excellent in the frequency characteristic of magnetic permeability and is high in a magnetic flux density (or magnetic induction).

In the prior art, in electrical instruments such as an electric power converting device, including a device for converting an alternate current to a direct current, a device for converting an alternate current having a certain frequency to another alternate current having a different frequency and a device for converting a direct current to an alternate current such as so called chopper, or a non-contact breaker, etc., there have been employed, as electrical circuit constituent elements thereof, semiconductor switching elements, typically thyristor and transistor, and reactors for relaxation of turn-on stress, commutation reactors, reactors for energy heat accumulation or transformers for matching connected to these elements.

As an example of such electric power converting devices, FIG. 1 shows an electrical circuit of a device for converting a direct current to an alternate current. The electric power converting device as shown in FIG. 1 is constituted of a semiconductor switching element 1, a reactor for relaxation of turn-on stress 2 and a transformer for matching 3. Also shown in FIG. 1 is an alternate current load 4 and a direct current load 5.

Through these reactors or transformers, a current containing a high frequency component reaching 100 KHz or higher, even to the extent over 500 KHz in some cases, may sometimes pass on switching of the semiconductors.

As the iron core constituting such a reactor or a transformer, there have been employed in the prior art such materials as shown below. That is, there may be mentioned:

(a) a laminated iron core prepared by laminating thin electromagnetic steel plates or permalloy plates having applied interlayer insulations;

(b) a so-called dust core prepared by caking carbonyl iron minute powders or permalloy minute powders with the use of, for example, a resin such as a phenolic resin; or (c) a so-called ferrite core prepared by sintering an oxide type magnetic material.

Among these, a laminated iron core, while it exhibits excellent electric characteristics at a commercial frequency band, is marked by iron loss of the iron core at higher frequency band, particularly increased eddy-current loss in proportion to the second power of a frequency. It has also the property that the magnetizing power can resist change at inner portions farther from the surface of plate materials constituting the iron core because of the skin effect of the iron core material. Accordingly, a laminated iron core can be used only at a magnetic flux density far lower than the saturated magnetic flux density inherently possessed by the iron core material itself, and there is also involved the problem of a very great eddy-current loss. Further, a laminated iron core has a problem of extremely lower effective magnetic permeability relative to higher frequency, as compared with that relative to commercial frequency. When a laminated iron core having these problems is to be used in a reactor, a transformer, etc. connected to a semiconductor switching element through which a current having a high frequency component passes, the iron core itself must be made to have great dimensions to compensate for effective magnetic permeability and magnetic flux density, whereby, also because of lower effective magnetic permeability, there is also involved the problem of increased copper loss.

On the other hand, there is employed as the iron core material a compressed powdery magnetic body called as dust core, as described in detail in, for example, Japanese Pat. No. 112235. However, such dust cores generally have considerably lower values of magnetic flux and magnetic permeability. Among them, even a dust core using carbonyl iron powders having a relatively higher magnetic flux density has a magnetic flux of only about 0.1 T and a magnetic permeability of only about $1.25\times10^{-5}$ H/m at a magnetizing force of 8000 A/m. Accordingly, in a reactor or a transformer using a dust core as the iron core material, the iron core must be inevitably made to have great dimensions, whereby there is involved the problem of increased copper loss in a reactor or a transformer.

Alternatively, a ferrite core employed in a small scale electrical instrument has a high specific resistivity value and a relatively excellent high frequency characteristic. However, a ferrite core has a magnetic flux density as low as about 0.4 T at a magnetizing force of 8000 A/m, and the values of magnetic permeability and the magnetic flux density at the same magnetizing force are respectively varied by some ten percents at −40° to 120° C., which is the temperature range useful for the iron core. For this reason, when a ferrite core is to be used as an iron core material for a reactor or a transformer connected to a semiconductor switching element, the iron core must be enlarged because of the small magnetic flux density. But a ferrite core, which is a sintered product, can be prepared with a great size only with difficulty and thus is not suitable as the iron core material. Also, a ferrite core involves the problems of great copper loss caused by its low magnetic flux density, of its great characteristic change when applied for a reactor or a transformer due to the great influence by temperatures on magnetic permeability and magnetic flux density, and further of increased noise generated from the iron core due to the greater magnetic distortion, as compared with a magnetic copper plate, etc.

SUMMARY OF THE INVENTION

An object of this invention is to provide an iron core material to be used for a reactor or a transformer connected to a semiconductor element, which has overcome the problems as described above, having an excellent frequency characteristic of magnetic permeability and a high magnetic flux density.

The iron core material of this invention comprises a high density compression molded product of a mixture of a magnetic powder of iron and/or an iron alloy having a mean particle diameter of 100$\mu$ or less and an insulating caking material.

In the following, this invention is to be described in further detail.

DETAILED DESCRIPTION OF PREFERRED EMBODIMENTS

Figure 1:
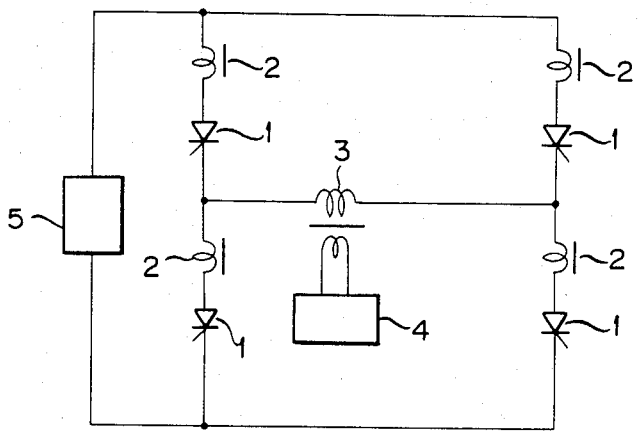
FIG. 1 shows, as already referred to in the foregoing, an example of an electric circuit in a device for converting direct current to alternate current.

The magnetic powder of iron and/or an iron alloy to be used in this invention is required to have a mean particle size or diameter of 100μ or less, but preferably not less than 2μ from a view point of practical use. This is because the aforesaid magnetic powder has a resistivity of 10 μΩ-cm to some ten μΩ-cm at the highest, and therefore in order to obtain sufficient iron core material characteristics even in an alternate current containing high frequencies yielding skin effect, the magnetic powder must be made into minute particles, thereby to have the particles from their surfaces to inner portions contribute sufficiently to magnetization.

Such a magnetic powder, when its mean particle size or diameter is represented by Dμ and its resistivity by ρμΩ-cm, is preferred to have a specific resistance value, when represented in terms of only the numerical value of $\rho/D^2$ satisfying the following relationship:

$$\rho/D^2 \geqq 4\times10^{-3}.$$

As such magnetic powder, there may be included, for example, iron powder, Fe-Si alloy powder, typically Fe-3%Si alloy powder, Fe-Al alloy powder, Fe-Ni alloy powder and the like, and one or more kinds selected from the group consisting of these may be employed.

The insulating caking material to be used in this invention has the function of binding the aforesaid magnetic powders simultaneously with insulation of the magnetic powder particules from each other, thereby imparting sufficient effective electric resistance value for alternate current magnetization to the iron core material as a whole.

As such insulating caking materials, there may be included various thermosetting and thermoplastic resins such as epoxy resins, polyamide resins, polyimide resins, polyester resins, polycarbonate resins, polyacetal resins, polysulfone resins, polyphenylene oxide resins and others, and one or more kinds selected from the group consisting of these may be used.

The molded product comprising the aforesaid magnetic powder and caking material may preferably have a composition, comprising 1.5 to 25% by volume of a caking material and the balance being a magnetic powder. At a level of a caking material less than 1.5% by volume, while there is no change in density and magnetic flux density of the iron core material as compared with those by addition of 1.5% by volume, effective resistivity is lowered. On the other hand, when the amount of a caking material exceeds 25% by volume, magnetic flux density and magnetic permeability are abruptly lowered, although there is no substantial increase in effective electric resistance.

The high density compression molded product which is the iron core material of this invention may be prepared, for example, as follows. That is, predetermined amounts of a magnetic powder and a caking material are mixed together, and then molded into a desired shape according to, for example, the compression molding method under pressure of 50–1000 MPa, to give a desired iron core material. If necessary, a heat treatment may also be applied on the molded product.

This invention is to be described in further detail by referring to the Examples set forth below.

EXAMPLE 1

A thermosetting epoxy type resin Epikote (tradename, available from Shell Chemical Co.) was added and formulated into Fe-1.5%Si alloy powders having a mean particle diameter of 37 to 50μ in various amounts as indicated in Table 1 (% by volume) based on the total amount of these components to prepare seven kinds of mixtures. These mixtures were compression molded under a molding pressure of 6 ton/cm$^2$ into a desired shape, followed by application of heat treatment for hardening at 200° C. for one hour, to obtain iron core materials.

COMPARATIVE EXAMPLE 1

Two kinds of iron core materials were obtained according to entirely the same procedure as in Example 1 except that the amounts of the thermosetting epoxy type resin were varied. The formulations are shown at the same time in Table 1.

For each of the nine kinds of the iron core materials obtained according to the above procedures in Sample Nos. 1–7 of Example 1 and Sample Nos. 8–9 of Comparative example 1, specific gravity, magnetic flux density at a magnetizing force of 8000 A/m and effective resistivity (the value calculated from the eddy-current loss of an iron core material for alternate current) were measured. The results are shown at the same time in Table 1.

TABLE 1

| Sample No. | Formulation (vol. %) Fe-1.5% Si alloy powder | Formulation (vol. %) Thermosetting epoxy type resin | Specific gravity (g/cm$^3$) | Magnetic flux density (T) | Effective resistivity (mΩ-cm) |
|---|---|---|---|---|---|
| Example 1 | | | | | |
| 1 | 98.5 | 1.5 | 7.4 | 1.4 | 85 |
| 2 | 95.0 | 5.0 | 7.3 | 1.35 | 180 |
| 3 | 92.0 | 8.0 | 7.1 | 1.25 | 260 |
| 4 | 88.0 | 12.0 | 6.9 | 1.2 | 350 |
| 5 | 85.0 | 15.0 | 6.7 | 1.15 | 380 |
| 6 | 80.0 | 20.0 | 6.5 | 1.1 | 470 |
| 7 | 76.0 | 24.0 | 6.2 | 1.0 | 530 |
| Comparative Example 1 | | | | | |
| 8 | 99.2 | 0.8 | 7.4 | 1.4 | 12 |
| 9 | 70.0 | 30.0 | 5.7 | 0.85 | 550 |

As apparently seen from the Table, the iron core material of this invention was confirmed to have excellent magnetic flux density and excellent effective resistivity at a magnetizing force of 8000 A/m.

When the iron core materials of Samples No.1 to No.7 according to the Example of this invention were subjected to measurements of changes in magnetic permeability and magnetic flux density at −40° to 120° C., the data obtained were all less than 10%.

Figure 2:
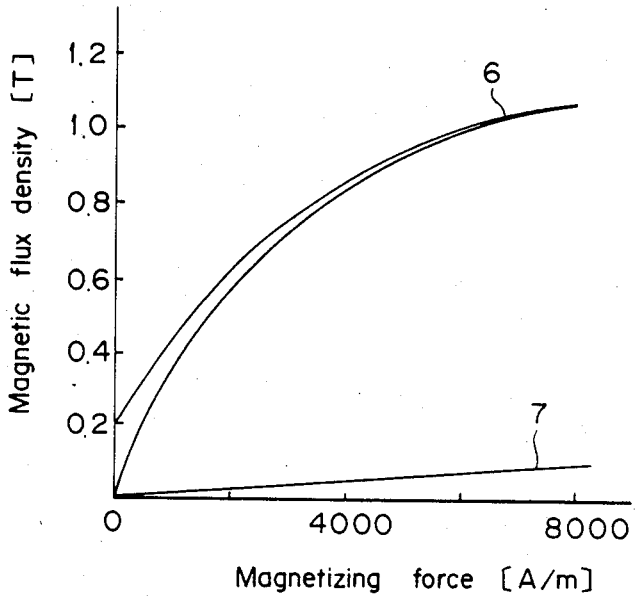
FIG. 2 shows direct current magnetization curves in an iron core material, according to Example 1, of this invention and a dust core of a prior art material.

FIG. 2 shows direct current magnetization curves representing changes in magnetic flux density for respective magnetizing forces, in which the curve 6 represents the direct current magnetization characteristic of the iron core material of Sample No.1 of this invention, and the curve 7 that of the iron core material comprising a dust core of the prior art. As apparently seen from FIG. 2, the iron core material of this invention was confirmed to be an excellent one having higher magnetic flux density, as compared with the iron core material comprising the dust core.

EXAMPLE 2

A thermosetting epoxy resin used in Example 1 was added and formulated into magnetic powders of Fe-3%Si alloy having mean diameters of 37 to 63μ in various amounts (% by volume) as shown in Table 2 based on the total amount of these components to prepare three kinds of mixtures. These mixtures (Sample Nos. 10–12) were subjected to the same procedure as in Example 1 to obtain respective iron core materials.

COMPARATIVE EXAMPLE 2

With the use of a permalloy having a plate thickness of 25μ, an iron core material was prepared by lamination of plates which had been subjected to interlayer insulation.

For each of the four kinds of iron materials obtained by application of the above treatments in Example 2 and Comparative example 2, effective magnetic permeability for alternate currents with frequencies of 1 KHz to 500 KHz were measured. The results are shown in Table 2.

TABLE 2

| Sample No. | Amount of resin (vol. %) | Effective magnetic permeability ($\times 10^{-4}$ H/m) | | | | | |
|---|---|---|---|---|---|---|---|
| | | 1 KHz | 10 KHz | 20 KHz | 100 KHz | 200 KHz | 500 KHz |
| Example 2 | | | | | | | |
| 10 | 12 | 2.20 | 2.20 | 2.20 | 2.20 | 2.20 | 2.11 |
| 11 | 20 | 1.97 | 1.97 | 1.97 | 1.97 | 1.97 | 1.88 |
| 12 | 24 | 1.70 | 1.70 | 1.70 | 1.70 | 1.70 | 1.63 |
| Comparative Example 2 | — | 0.55 | 0.55 | 0.50 | 0.44 | 0.34 | 0.20 |

As apparently seen from the Table, it was confirmed that the iron core material of this invention had effective magnetic permeabilities with very little change in the frequency band of 1 KHz to 500 KHz, as compared with the laminated iron core using a permalloy, and also that its value was excellently high.

EXAMPLE 3

A polyamide resin Amilan (tradename, available from Toray Industries, Inc.) was added and formulated into iron powders having mean diameters of 44 to 100μ as shown in Table 3 in an amount of 1.5% by volume based on the total amount of these components to prepare four kinds of mixtures. These mixtures were molded according to the same procedure as in Example 1, followed by application of heat treatment at 160° C. for one hour to obtain respective iron cores.

COMPARATIVE EXAMPLE 3

According to entirely the same procedure as in Example 3 except for using iron powders having a mean diameter over 100μ, two kinds of iron core materials were obtained.

For each of the six kinds of iron core materials obtained by the above treatments in Example 3 and Comparative example 3, effective resistivity was determined from the eddy-current loss for an alternate current magnetization. The results are shown in Table 3.

TABLE 3

| | Sample No. | Mean particle diameter (μ) | Effective resistivity (mΩ - cm) |
|---|---|---|---|
| Example 3 | 13 | 44 | 65 |
| | 14 | 53 | 55 |
| | 15 | 70 | 40 |
| | 16 | 100 | 18 |
| Comparative Example 3 | 17 | 150 | 5 |
| | 18 | 250 | 4 |

As apparently seen from the Table, the iron core materials of this invention with the use of magnetic powders of mean diameters of 100μ or less were confirmed to exhibit higher effective electric resistance as the particle diameter was smaller, and their values were greater by several figures as compared with the resistivity of iron powders.

In case when magnetic powders of Fe-3% Si alloy were employed in place of iron powders, a similarly high effective resistivity was confirmed to be exhibited.

EXAMPLE 4 AND COMPARATIVE EXAMPLE 4

A thermosetting epoxy resin used in Example 1 was added to various powders of iron and iron-base alloys having different mean particles diameters as shown in Table 4 in an amount of 12% by volume, and each mixture was compression molded under a molding pressure of 6 ton/cm$^2$ into a desired shape, followed by heat treatment at 190° C. for 2 hours to obtain iron core materials.

For these iron core materials, effective permeabilities at 1 KHz to 500 KHz were measured, and the results represented by the ratios to the standard of the effective permeability at 1 KHz are shown in Table 4.

As apparently seen from Table 4, when the mean particle diameter of iron or iron-base alloy powder is represented by D μm and its resistivity by ρμΩ-cm, and when the resistance value represented in terms of only the numerical value of $\rho/D^2$ satisfies the following relationship:

$$\rho/D^2 \geqq 4\times 10^{-3},$$

it was confirmed that the change in effective permeability between 1 and 500 kHz was 10% or less.

TABLE 4

| Sample No. | Composition | Iron.Iron base alloy powder: Specific resistivity | Mean particle diam. | $\frac{\rho}{D^2}$ | Change in effective magnetic permeability (1 KHz = 1): 1 KHz | 100 KHz | 300 KHz | 500 KHz |
|---|---|---|---|---|---|---|---|---|
| Example 4 | | | | | | | | |
| 19 | 3.2% Si—Fe | 45 | 97 | $4.78 \times 10^{-3}$ | 1 | 1.00 | 0.98 | 0.95 |
| 20 | 6.5% Si—Fe | 80 | 50 | $3.2 \times 10^{-2}$ | 1 | 1.00 | 0.99 | 0.98 |
| 21 | 1.7% Al—Fe | 27 | 69 | $5.67 \times 10^{-3}$ | 1 | 1.00 | 0.98 | 0.95 |
| 22 | Fe | 10 | 44 | $5.17 \times 10^{-3}$ | 1 | 1.00 | 0.98 | 0.94 |
| Comparative Example 4 | | | | | | | | |
| 23 | 3.2% Si—Fe | 45 | 115 | $3.4 \times 10^{-3}$ | 1 | 0.98 | 0.90 | 0.85 |
| 24 | Fe | 10 | 53 | $3.56 \times 10^{-3}$ | 1 | 0.98 | 0.89 | 0.77 |
| 25 | Fe | 10 | 97 | $1.06 \times 10^{-3}$ | 1 | 0.97 | 0.78 | 0.64 |
| 26 | 1.7% Al—Fe | 27 | 105 | $2.44 \times 10^{-3}$ | 1 | 0.98 | 0.89 | 0.83 |

EXAMPLE 5

A mixture comprising 40% of Fe-3%Al powders having a mean diameter of 74μ, 45% of iron powders having mean diameters of 37 to 44μ and 15% of polyamide resin was compression molded under a pressure of 6 ton/cm, followed by applicaiton of heat treatment at 100° C. for one hour, to obtain an iron core material. This iron core material was confirmed to have a magnetic flux density of 1.1 T at a magnetization force of 8000 A/m and an effective magnetic permeability of $2.2 \times 10^{-4}$ at 200 KHz.

As apparently seen from Examples, the iron core material of this invention has a value of 1 T or more at a magnetization force of 8000 A/m which is two times or greater as compared with a ferrite core or a dust core, and also has an effective magnetic permeability of by far greater value with little change in the frequency band of 1 KHz to 500 KHz as compared with a laminated iron core.

We claim:

1. An iron core material, comprising a high density compression molded product comprising a mixture of (a) a magnetic powder comprised of iron or iron alloy said magnetic powder having a mean particle size of 100 μm or less and a specific resistance value which satisfies the relationship $$\rho/D^2 \geqq 4 \times 10^{-3}$$

where the mean particle size and resistivity of said magnetic powder is Dμ and ρμΩ-cm, respectively, and (b) an insulating caking material comprising one or more resins selected from the group consisting of a thermosetting resin and a thermoplastic resin, such that said product contains between about 1.5% and about 25% by volume of said caking material.

2. The iron core material according to claim 1, wherein said magnetic powder is one or more of powder selected from the group consisting of iron powder, Fe-Si alloy powder, Fe-Al alloy powder and Fe-Ni alloy powder.

3. The iron core material according to claim 1, wherein said magnetic powder has a mean particle size of from 2 to 100 μm.

4. The iron core material according to claim 1, wherein said resins are thermosetting resins selected from the group consisting of an epoxy resin, a polyamide resin, a polyimide resin, a polyester resin, a polycarbonate resin, a polyacetal resin, a polysulfone resin, and a polyphenylene oxide resin.

5. An iron core material according to claim 1, wherein the resistivity of said magnetic powder ranges between about 85 and about 530 mΩ·cm.

6. An iron core material according to claim 2, wherein said magnetic powder is comprised of iron and has a mean particle size of 50 μm or less.

* * * * *